US008556584B2

(12) United States Patent
Mallaiah et al.

(10) Patent No.: US 8,556,584 B2
(45) Date of Patent: Oct. 15, 2013

(54) ROTATING COMPONENT OF A TURBINE ENGINE

(75) Inventors: Pradeep Kumar Mallaiah, Karnataka (IN); Sabarinath Devarajan, Karnataka (IN); Asim Kumar Ghosal, Karnataka (IN); Yatheesh Aluvala Kumar, Karnataka (IN)

(73) Assignee: General Electric Company, Schenectady, NY (US)

( * ) Notice: Subject to any disclaimer, the term of this patent is extended or adjusted under 35 U.S.C. 154(b) by 416 days.

(21) Appl. No.: 13/020,584

(22) Filed: Feb. 3, 2011

(65) Prior Publication Data

US 2012/0201669 A1 Aug. 9, 2012

(51) Int. Cl.
*F01D 5/14* (2006.01)

(52) U.S. Cl.
USPC ..... 416/185; 416/223 B

(58) Field of Classification Search
USPC ..... 416/179, 182, 183, 185, 188, 223 A, 416/223 B, 228, 231 B, 235, 236 R; 415/209.1; 29/889.23, 889, 889.1, 29/889.4
See application file for complete search history.

(56) References Cited

U.S. PATENT DOCUMENTS

| | | | | |
|---|---|---|---|---|
| 4,089,618 | A * | 5/1978 | Patel | 416/228 |
| 4,775,270 | A * | 10/1988 | Katayama et al. | 409/132 |
| 5,511,946 | A * | 4/1996 | Lee et al. | 416/97 R |
| 6,210,116 | B1 * | 4/2001 | Kuczaj et al. | 416/185 |
| 6,494,683 | B1 * | 12/2002 | Nolan et al. | 416/219 R |
| 6,537,030 | B1 * | 3/2003 | Garrison | 416/185 |
| 6,733,240 | B2 * | 5/2004 | Gliebe | 416/228 |
| 6,830,436 | B2 * | 12/2004 | Shibata et al. | 416/228 |
| 7,160,084 | B2 * | 1/2007 | Ahmad | 416/231 B |
| 2004/0071552 | A1 * | 4/2004 | Truitt et al. | 416/223 A |
| 2004/0123459 | A1 * | 7/2004 | Makinson et al. | 29/889.23 |
| 2009/0047133 | A1 * | 2/2009 | Nishino | 416/213 A |
| 2010/0037458 | A1 * | 2/2010 | Ranz et al. | 29/889 |
| 2010/0209257 | A1 * | 8/2010 | Fuglsang et al. | 416/90 R |

FOREIGN PATENT DOCUMENTS

EP 661414 A1 * 7/1995

* cited by examiner

*Primary Examiner* — Richard Edgar
(74) *Attorney, Agent, or Firm* — Cantor Colburn LLP

(57) ABSTRACT

A rotating component of a turbine engine is provided and includes a wheel having a face to which fluid flow is provided and a plurality of impeller vanes forming a plurality of grooves along which the fluid flow is directed from an outer to an inner diameter of the wheel face, at least one of the plurality of the impeller vanes including a radially inwardly facing vane surface formed to define a cutaway portion.

20 Claims, 3 Drawing Sheets

ROTATING COMPONENT OF A TURBINE ENGINE

BACKGROUND OF THE INVENTION

The subject matter disclosed herein relates to a rotating component of a turbine engine and, more particularly, to an impeller with a saw cut design to improve durability.

In gas turbine engines, high energy and high temperature fluids are provided to a turbine where the fluids are expanded for the production of mechanical and electrical energy. This fluid expansion is facilitated by various rotating components that rotate about a common rotational axis.

The rotating components include, for example, an impeller wheel that is rotatable about the rotational axis with impeller vanes provided on a face thereof. The impeller vanes direct secondary flow from an outer turbine diameter to an inner turbine diameter. During transient operations of the turbine, however, the impeller vanes are exposed conditions that cause them to heat and cool relatively quick. This causes high thermal gradient across the impeller wheel, which leads to development of high thermal stresses at the inner diameter of the impeller wheel (this includes both compressive stresses experienced during start-up and tensile stresses experienced during shut down). These mechanical stresses due to speed and gas loads and thermal stresses interact at common locations and cause damage that reduces the impeller wheel's fatigue life.

BRIEF DESCRIPTION OF THE INVENTION

According to one aspect of the invention, a rotating component of a turbine engine is provided and includes a wheel having a face to which fluid flow is provided and a plurality of impeller vanes forming a plurality of grooves along which the fluid flow is directed from an outer to an inner diameter of the wheel face, at least one of the plurality of the impeller vanes including a radially inwardly facing vane surface formed to define a cutaway portion.

According to another aspect of the invention, a rotating component of a turbine engine is provided and includes a wheel, which is rotatable about a rotational axis, having a face to which fluid flow is provided and a plurality of impeller vanes protruding axially from the wheel face to form a plurality of grooves between adjacent ones of the plurality of impeller vanes along which the fluid flow is directed from an outer to an inner diameter of the wheel face, at least one of the plurality of the impeller vanes including an inner diameter portion at which a vane surface faces radially inwardly, the vane surface being formed to define a cutaway portion.

According to yet another aspect of the invention, a method of forming a rotating component of a turbine engine is provided and includes fashioning a wheel having a face to which fluid flow is provided and forming on the wheel face a plurality of grooves along which the secondary flow is directed from an outer to an inner diameter of the wheel face and machining a cutaway portion at a radially inwardly facing vane surface of at least one of the plurality of the impeller vanes.

These and other advantages and features will become more apparent from the following description taken in conjunction with the drawings.

BRIEF DESCRIPTION OF THE DRAWING

The subject matter which is regarded as the invention is particularly pointed out and distinctly claimed in the claims at the conclusion of the specification. The foregoing and other features, and advantages of the invention are apparent from the following detailed description taken in conjunction with the accompanying drawings in which:

The detailed description explains embodiments of the invention, together with advantages and features, by way of example with reference to the drawings.

DETAILED DESCRIPTION OF THE INVENTION

In accordance with aspects, thermal and mechanical stress interactions applied to a rotating component of a turbine engine are separated and total stresses on the component as well as various other components of the turbine engine are reduced significantly. This stress reduction is provided by a unique design, which may be implemented on new components and retrofit into existing fleets.

Figure 1:
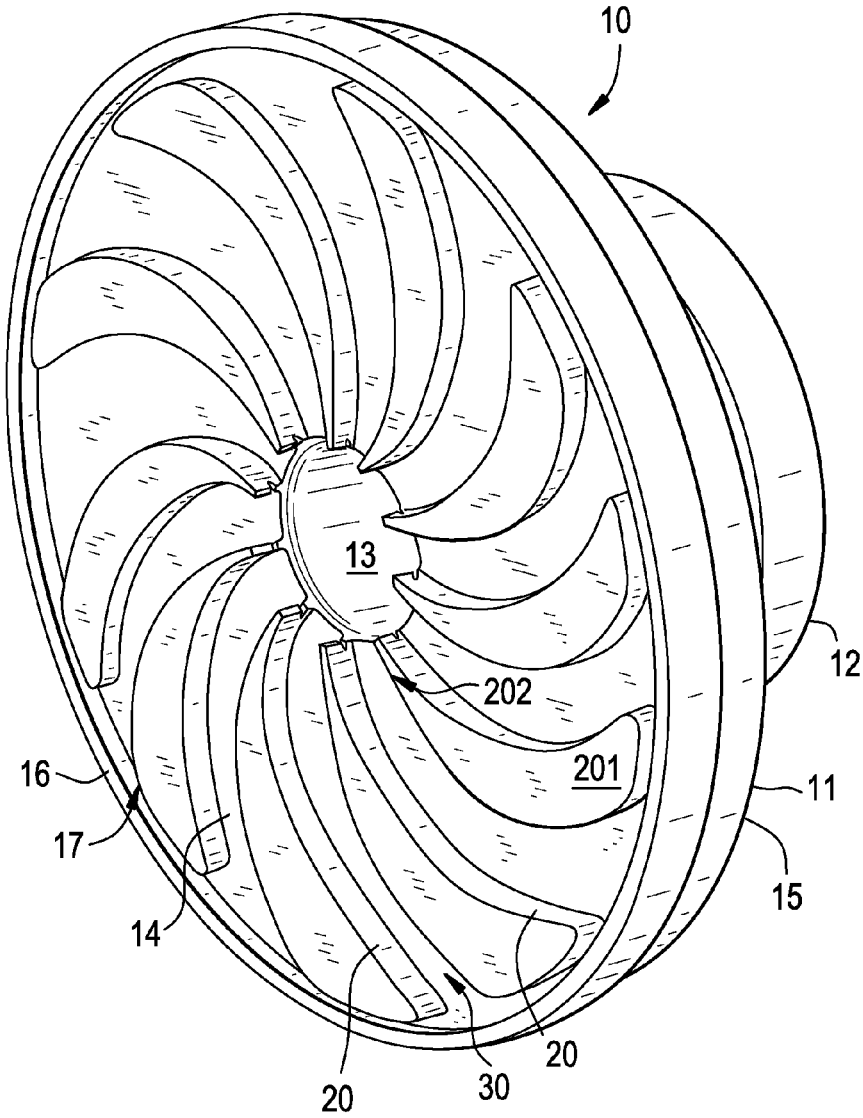
FIG. 1 is a perspective view of an impeller of a turbine engine.
Figure 2:
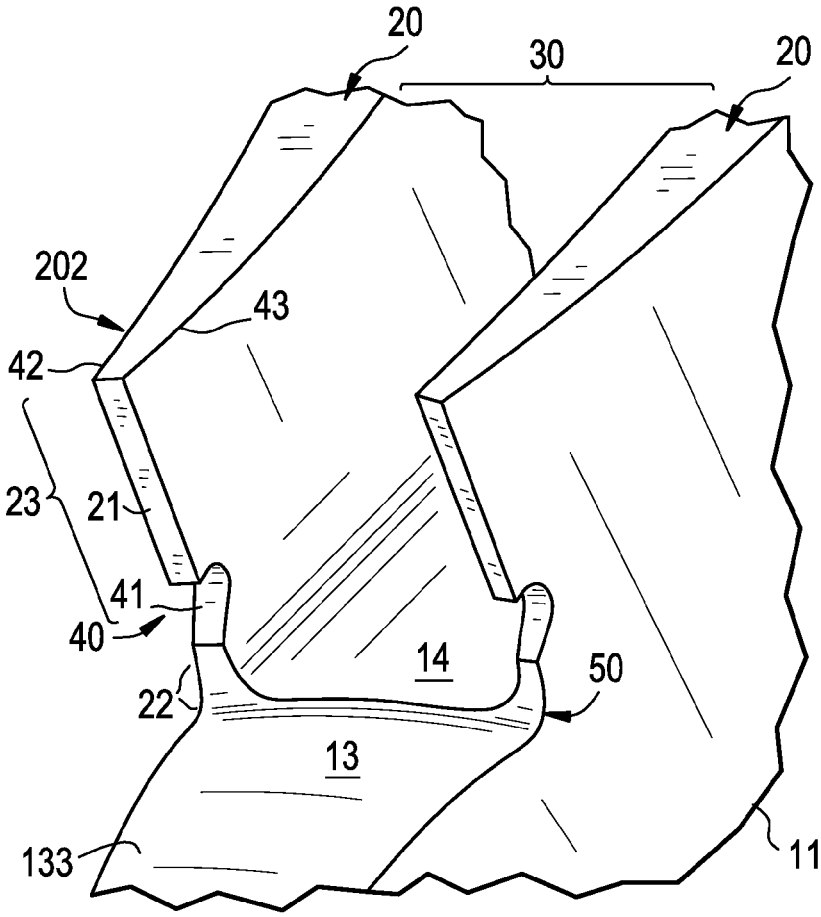
FIG. 2 is an enlarged perspective view of a radially inward region of the impeller of FIG. 1.
Figure 3:
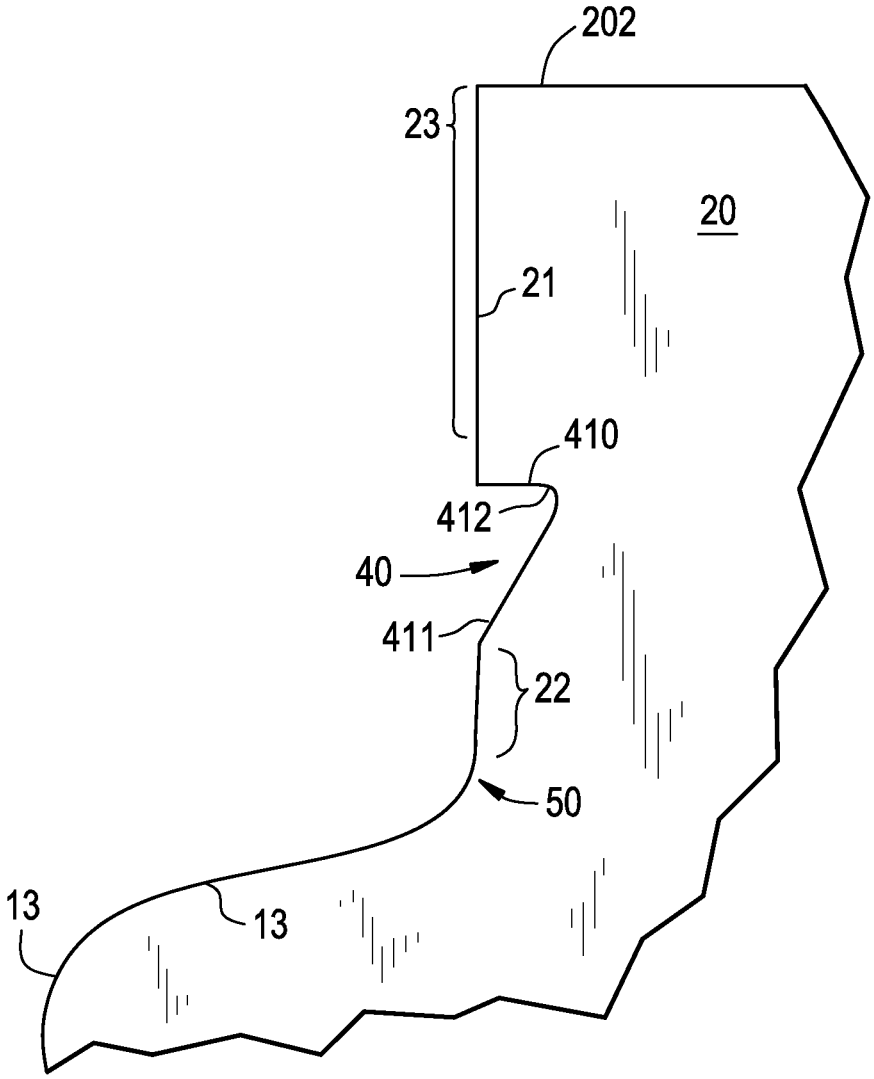
FIG. 3 is a side view of the radially inward region of FIG. 2.

With reference to FIGS. 1-3, a rotating component 10 of a turbine engine is provided and, as shown in FIG. 1, may be for example an impeller of a gas turbine engine although it is to be understood that this is merely exemplary and that other rotating components may be substituted to similar effect. The rotating component 10 includes a wheel 11 and a forward section 12, which are each rotatable about a common rotational axis extending through the bore 13. The bore 13 is defined at a radially central region of the rotating component 10 and extends axially through the wheel 11 and the forward section 12.

The wheel 11 includes a curved surface 133 that is formed to be disposed about the bore 13. The wheel 11 further includes an aft wheel face 14 extending radially outwardly from the curved surface 133, a forward wheel face 15, which opposes the aft wheel face 14, and a rim 16 at an outer radial diameter of the aft wheel face 14. A plurality of impeller vanes 20 protrudes axially from and may be arrayed circumferentially about the aft wheel face 14. Outer diameter portions 201 of the plurality of impeller vanes 20 are radially displaced from the rim 16 to define a cavity 17 at the outer radial diameter of the aft wheel face 14.

The plurality of impeller vanes 20 form a plurality of grooves 30 between adjacent ones of the plurality of impeller vanes 20 that extend from the cavity 17 to a radially inward diameter of the aft wheel face 14. In accordance with embodiments, each of the plurality of impeller vanes 20 may have a substantially similar geometry and may spiral radially inwardly. During turbine operations, including transient turbine operations, fluids flow toward the cavity 17 and the plurality of circumferentially arrayed grooves 30 direct this fluid flow to proceed from the cavity 17 to the radially inward diameter of the aft wheel face 14.

Each of the plurality of impeller vanes 20 includes the outer diameter portion 201, an inner diameter portion 202, which may be narrower than the outer diameter portion 201, and, at the inner diameter portion 202, a vane surface 21 that faces radially inwardly. The vane surface 21 of at least one of the plurality of the impeller vanes 20 is formed to define a cutaway portion 40 between relatively short axial section 22 and relatively long axial section 23 such that the cutaway portion 40 is defined axially proximate to the aft wheel face 14. With the cutaway portion 40 so defined, thermal responses and/or growth of the plurality of impeller vanes 20 are decoupled from the rotating component 10 thus reducing stress to avoid damage thereto. Hence, a lifetime of the rotating component 10 may be extended.

As shown in FIGS. 2 and 3, the respective inner diameter portions 202 of each impeller vane 20 are each radially proximate to the bore 13 and the curved surface 133 such that interfaces 50 are formed between the respective vane surfaces 21 and the curved surface 133. In accordance with embodiments, the interfaces 50 may have a curvature that opposes that of the curved surface 133.

As further shown in FIGS. 2 and 3, the respective vane surfaces 21 of each of the plurality of impeller vanes 20 where the cutaway portion 40 is defined may include a circumferential surface 41 that forms a periphery of the cutaway portion 40 and extends between divergent sidewalls 42 and 43. The circumferential surface 41 is relatively flat in the circumferential direction and a plane thereof is substantially parallel with a plane of the corresponding vane surface 21.

In accordance with embodiments, each of the circumferential surfaces 41 may include a first surface 410, a second surface 411 and a shoulder surface 412 interposed between the first and second surfaces 410 and 411 to define the respective cutaway portions 40. Each of the first surfaces 410 may be leveled and each of the second surfaces 411 may be angled, closer to the aft wheel face 14 than the first surfaces 410 and longer than the first surfaces 410. The shoulder surface 412 may be angular or curved.

In accordance with aspects, the rotating component 10 as described above may be formed as a new feature whereby the cutaway portion 40 is either cast or machined into the at least one of the plurality of the impeller vanes 20. Alternatively, the rotating component 10 can be formed in a retrofit, repair or refurbishing operation whereby the cutaway portion 40 is machined into the at least one of the plurality of the impeller vanes 20. The machining in either case may be achieved by various processes including, but not limited to, electro-dynamic machining (EDM), milling or abrading.

While the invention has been described in detail in connection with only a limited number of embodiments, it should be readily understood that the invention is not limited to such disclosed embodiments. Rather, the invention can be modified to incorporate any number of variations, alterations, substitutions or equivalent arrangements not heretofore described, but which are commensurate with the spirit and scope of the invention. Additionally, while various embodiments of the invention have been described, it is to be understood that aspects of the invention may include only some of the described embodiments. Accordingly, the invention is not to be seen as limited by the foregoing description, but is only limited by the scope of the appended claims.

The invention claimed is:

1. A rotating component of a turbine engine, comprising:

a wheel having a face to which fluid flow is provided; and a plurality of impeller vanes forming a plurality of grooves along which the fluid flow is directed from an outer to an inner diameter of the wheel face, at least one of the plurality of the impeller vanes including a radially inwardly facing vane surface formed to define a cutaway portion.

2. The rotating component according to claim 1, wherein the vane surface comprises a relatively flat circumferential surface.

3. The rotating component according to claim 2, wherein the circumferential surface comprises a first surface, a second surface and a shoulder surface interposed between the first and second surfaces.

4. The rotating component according to claim 3, wherein the first surface is leveled and the second surface is angled.

5. The rotating component according to claim 3, wherein the second surface is longer and closer to the wheel face than the first surface.

6. The rotating component according to claim 3, wherein the shoulder surface is one of angular or curved.

7. The rotating component according to claim 1, wherein the cutaway portion is axially proximate to the wheel face.

8. The rotating component according to claim 1, wherein the wheel comprises a rim at an outer radial diameter of the face, outer diameter portions of the plurality of impeller vanes being radially displaced from the rim to define a cavity at the outer radial diameter of the face.

9. The rotating component according to claim 1, wherein the radially inwardly facing vane surface comprises a short axial section and a long axial section and the cutaway portion is defined by:

a first surface defining a right angle with a proximal end of the long axial section;

a second surface defining an obtuse angle with a distal end of the short axial section; and a curved shoulder surface extending between outward radial ends of the long and short axial sections.

10. A rotating component of a turbine engine, comprising:

a wheel, which is rotatable about a rotational axis, having a face to which fluid flow is provided; and a plurality of impeller vanes protruding axially from the wheel face to form a plurality of grooves between adjacent ones of the plurality of impeller vanes along which the fluid flow is directed from an outer to an inner diameter of the wheel face, at least one of the plurality of the impeller vanes including an inner diameter portion at which a vane surface faces radially inwardly, the vane surface being formed to define a cutaway portion.

11. The rotating component according to claim 10, wherein the wheel is formed to define a bore at a central region thereof and includes a curved surface disposed about the bore.

12. The rotating component according to claim 11, wherein the respective inner diameter portions are proximate to the bore to define curved interfaces between the respective vane surfaces and the curved surface.

13. The rotating component according to claim 10, wherein the vane surface comprises a relatively flat circumferential surface.

14. The rotating component according to claim 13, wherein the circumferential surface comprises a first surface, a second surface and a shoulder surface interposed between the first and second surfaces.

15. The rotating component according to claim 14, wherein the first surface is leveled and the second surface is angled.

16. The rotating component according to claim 15, wherein the second surface is longer and closer to the wheel face than the first surface.

17. The rotating component according to claim 14, wherein the shoulder surface is one of angular or curved.

18. The rotating component according to claim 10, wherein the cutaway portion is axially proximate to the wheel face.

19. A method of forming a rotating component of a turbine engine, comprising:

fashioning a wheel having a face to which fluid flow is provided; and forming on the wheel face a plurality of grooves along which the secondary flow is directed from an outer to an inner diameter of the wheel face; and machining a cutaway portion at a radially inwardly facing vane surface of at least one of the plurality of the impeller vanes.

20. The method according to claim 19, wherein the machining comprises machining the cutaway portion proximate to the wheel face.

* * * * *